US011920579B2

(12) United States Patent
Surjaatmadja et al.

(10) Patent No.: US 11,920,579 B2
(45) Date of Patent: Mar. 5, 2024

(54) COMPACT HIGH PRESSURE, HIGH LIFE INTENSIFIER PUMP SYSTEM

(71) Applicant: Halliburton Energy Services, Inc., Houston, TX (US)

(72) Inventors: Jim Basuki Surjaatmadja, Duncan, OK (US); Tim Holiman Hunter, Duncan, OK (US)

(73) Assignee: Halliburton Energy Services, Inc., Houston, TX (US)

( * ) Notice: Subject to any disclaimer, the term of this patent is extended or adjusted under 35 U.S.C. 154(b) by 437 days.

(21) Appl. No.: 17/272,023

(22) PCT Filed: Oct. 5, 2018

(86) PCT No.: PCT/US2018/054682

§ 371 (c)(1),
(2) Date: Feb. 26, 2021

(87) PCT Pub. No.: WO2020/072076

PCT Pub. Date: Apr. 9, 2020

(65) Prior Publication Data

US 2021/0348605 A1 Nov. 11, 2021

(51) Int. Cl.
*F04B 47/04* (2006.01)
*E21B 43/12* (2006.01)
(Continued)

(52) U.S. Cl.
CPC ..... *F04B 47/04* (2013.01); *E21B 43/126* (2013.01); *F04B 9/10* (2013.01); *F04B 17/05* (2013.01); *F04B 53/143* (2013.01)

(58) Field of Classification Search
CPC .. F04B 9/08–107; F04B 17/05; F04B 53/143; F04B 9/10–1076; F04B 47/04; F04B 49/02; E21B 43/126
See application file for complete search history.

(56) References Cited

U.S. PATENT DOCUMENTS 3,249,053 A * 5/1966 Govan ..... F15B 3/00 417/46
3,423,935 A * 1/1969 Budzich ..... F15B 11/00 60/462
(Continued)

FOREIGN PATENT DOCUMENTS

CN 100567730 C * 12/2009
EP 3088736 A1 * 11/2016 ..... F04B 13/00
(Continued)

OTHER PUBLICATIONS

International Search Report and Written Opinion issued in related PCT Application No. PCT/US2018/054682 dated Jul. 4, 2019, 13 pages.

*Primary Examiner* — Alexander B Comley
(74) *Attorney, Agent, or Firm* — Conley Rose, P.C.; Rodney B. Carroll

(57) ABSTRACT

A pumping system pumps material or fluid downhole, for example, to perform a stimulation operation. The pumping system can include a hydraulic pump coupled to an intensifier. The intensifier may have a piston which allows for a small footprint as compared to an intensifier with a plunger. The hydraulic cylinder of the intensifier may be protected from the corrosive, erosive and/or abrasive effects of the material or fluid to be pumped by one or more seals. Using the intensifier that includes a piston may provide for a greater reliability of the overall pumping system, as fewer strokes are required, and a compact pumping system, as the stroke length of the intensifier with a piston is less than the stroke length required for a plunger.

20 Claims, 5 Drawing Sheets

(51) Int. Cl.

| | |
|---|---|
| ***F04B 9/10*** | (2006.01) |
| ***F04B 17/05*** | (2006.01) |
| ***F04B 53/14*** | (2006.01) |

(56) References Cited

U.S. PATENT DOCUMENTS

| | | | | |
|---|---|---|---|---|
| 3,700,360 | A * | 10/1972 | Shaddock | F04B 53/164 91/275 |
| 4,077,746 | A * | 3/1978 | Reynolds | F15B 3/00 417/225 |
| 6,267,571 | B1 | 7/2001 | Anderson et al. | |
| 7,451,742 | B2 * | 11/2008 | Gibson | F04B 9/1172 123/456 |
| 9,377,010 | B1 | 6/2016 | Madgwick | |
| 2006/0008364 | A1 * | 1/2006 | Traylor | F04B 47/08 417/390 |
| 2006/0171821 | A1 * | 8/2006 | Brown | F04B 47/08 417/390 |
| 2008/0105316 | A1 | 5/2008 | Serafin et al. | |
| 2009/0041596 | A1 | 2/2009 | Ponomarev et al. | |
| 2009/0317267 | A1 | 12/2009 | Gill et al. | |
| 2011/0052417 | A1 | 3/2011 | Wells | |
| 2011/0176940 | A1 | 7/2011 | Ellis et al. | |
| 2014/0007568 | A1 | 1/2014 | Crowley | |
| 2015/0192117 | A1 | 7/2015 | Bridges | |
| 2016/0298614 | A1 * | 10/2016 | Gaillard | F04B 9/113 |
| 2017/0009761 | A1 | 1/2017 | Bilousov et al. | |
| 2018/0135606 | A1 | 5/2018 | Oklegas, Jr. | |
| 2018/0189702 | A1 | 7/2018 | Hunter et al. | |

FOREIGN PATENT DOCUMENTS

| | | | |
|---|---|---|---|
| WO | 2016/133400 | A1 | 8/2016 |
| WO | WO-2016133400 | A1 * | 8/2016 |

* cited by examiner

COMPACT HIGH PRESSURE, HIGH LIFE INTENSIFIER PUMP SYSTEM

CROSS-REFERENCE TO RELATED APPLICATION

The present application is a U.S. National Stage Application of International Application No. PCT/US2018/054682 filed Oct. 5, 2018, which is incorporated herein by reference in its entirety for all purposes.

TECHNICAL FIELDS

The present disclosure relates generally to pumping systems, and more specifically (although not necessarily exclusively), to systems and methods for a pumping system that pumps fluid or material downhole at a high pressure using an intensifier pump system.

BACKGROUND

Pumping systems are used for hydrocarbon exploration, recovery and production operations to stimulate a specified formation area. These pumping systems must pump a fluid or a material downhole at a required pressure. The required pressure for a given operation increases with historical time. For example, as the depth downhole that must be traversed increases, the pump pressure required to stimulate the formation surrounding a borehole or well bore increases. For example, at a depth of 15,000 feet (approximately 4,572 meters) requires a pressure of about 8250 pounds per square inch (psi) (approximately 56881.748 kilopascal) for a stimulation operation without even considering viscosity, friction and fracturing initiation pressure which could increase the required pressure by a factor of 2.

Conventional pumping system requirements may exceed 18,000 psi (approximately 124105.631 kilopascal). While convention pumping systems operate to provide high pressure outputs, such operation is not without adverse effects. For example, the life expectancy of the pumping system decreases while the costs associated with repairs due to wear and tear on the pumping system increase when the pumping system is operated to meet such high pressure requirements. Intensifier pumps (or an intensifier) may be used to facilitate the operation of the pumping system. For example, a conventional pump may have an 8-10 inch (approximately 20.32 centimeters (cm) to 25.4 cm) stroke while an intensifier may have a 60 inch (approximately 152.4 cm) or greater stroke. Including an intensifier may reduce the strokes by at least six-to-one. A conventional pump may experience an increase in life expectancy of about six times or more. However, intensifiers generally require a large or significant footprint. For example, an intensifier with a 60 inch (approximately 152.4 cm) stroke may require equipment with a length between 18 to 25 feet (approximately 5.49 meters to 7.62 meters). Thus, an efficient pumping system that operates within a small footprint and provides the required high pressure outputs while minimizing costs of inspection, repair and replacement is needed.

DETAILED DESCRIPTION

Figure 1:
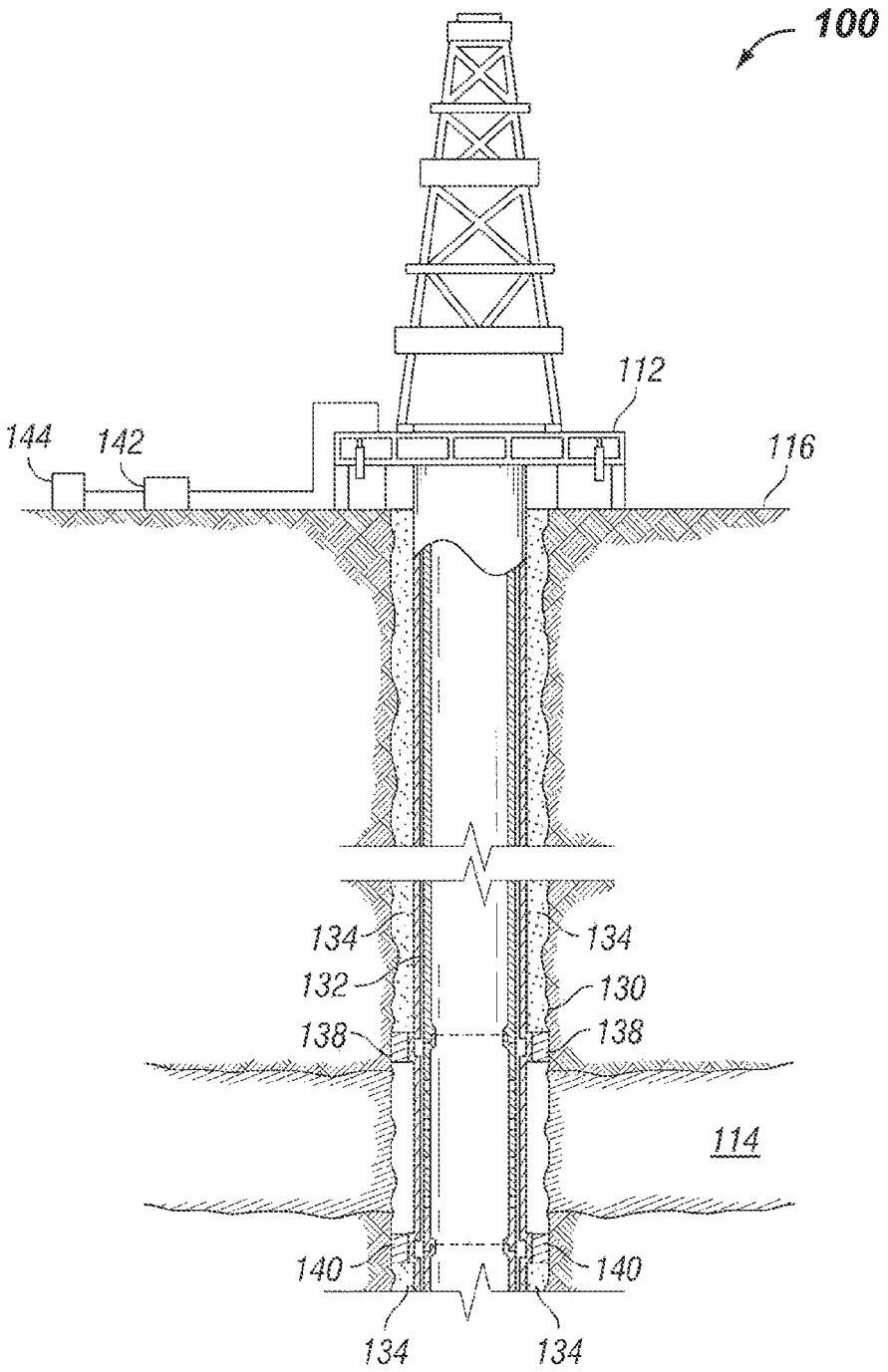
FIG. 1 is a schematic diagram of an apparatus for transferring material in a wellbore, according to one or more aspects of the present disclosure.

Certain aspects and features of the present disclosure relate to an efficient and compact pumping system. As depths of drilling operations have increased, so has the need for pumping systems that perform reliably for extended durations during high pressure downhole operations, for example, during a stimulation operation. To extend the life of pumping systems, the pumping system may include a power source that powers an intensifier through one or more hydraulic pumps. Using intensifiers extends the life expectancy of a conventional pumping system which also increases reliability of the overall pumping system. However, these conventional intensifiers typically require an extensive footprint. For example, an intensifier with a five foot stroke may require equipment with a length of 18 to 25 feet. Such equipment has a weight and size that is cumbersome not only to transport but also to move about a site.

The present invention overcomes the problem of providing a reliable pumping system that can operate at high pressures for an extended duration within a manageable or compact footprint by including a piston-based intensifier in a pumping system. The pumping system of the present disclosure utilizes an intensifier pumping system that comprises a piston instead of a traditional plunger-based intensifier. While pistons are not generally suitable for certain environments, for example, hydrocarbon exploration, recovery and production sites, as pistons are commonly known as debris intolerant, the present disclosure provides an intensifier pumping system that provides the required high pressure for a downhole operation while minimizing corrosive, erosive and abrasive effects of the material or fluid to be pumped downhole or pressurized by using a piston-based intensifier with a disposable, replaceable or repairable cylinder system. The present invention may improve life expectancy of the conventional hydraulic pumping system by reducing the number of strokes of the hydraulic pumps of the hydraulic pumping system and thereby reducing wear and tear of the components of the hydraulic pumping system. For example, addition of the improved intensifier pumping system may reduce the number of strokes by at least twelve times. Reducing the number of strokes also provides increased reliability and with increased reliability comes a reduction in costs and time required to complete an operation. The improved intensifier pumping system also provides for ease of inspection, maintenance repair and replacement of components. The improved intensifier pumping system discussed herein may utilize new technologies for piston based seals that may include wipers that may increase the ability of the piston system to withstand exposer to abrasives, harsh chemicals or other operating conditions. Additionally, the improved intensifier pumping system discussed herein may utilize a clean side that incorporates a piston system or assembly and a dirty side that utilizes one or more plungers.

These illustrative examples are given to introduce the reader to the general subject matter discussed here and are not intended to limit the scope of the disclosed concepts. The following sections describe various additional features and examples with reference to the drawings in which like numerals indicate like elements, and directional descriptions are used to describe the illustrative aspects but, like the illustrative aspects, should not be used to limit the present disclosure.

For purposes of this disclosure, an information handling system may include any instrumentality or aggregate of instrumentalities operable to compute, classify, process, transmit, receive, retrieve, originate, switch, store, display, manifest, detect, record, reproduce, handle, or utilize any form of information, intelligence, or data for business, scientific, control, or other purposes. For example, an information handling system may be a personal computer, a network storage device, or any other suitable device and may vary in size, shape, performance, functionality, and price. The information handling system may include random access memory (RAM), one or more processing resources such as a central processing unit (CPU) or hardware or software control logic, ROM, and/or other types of nonvolatile memory. Additional components of the information handling system may include one or more disk drives, one or more network ports for communication with external devices as well as various input and output (I/O) devices, such as a keyboard, a mouse, and a video display. The information handling system may also include one or more buses operable to transmit communications between the various hardware components. The information handling system may also include one or more interface units capable of transmitting one or more signals to a controller, actuator, or like device.

For the purposes of this disclosure, computer-readable media of an information handling system may comprise any instrumentality or aggregation of instrumentalities that may retain data and/or instructions for a period of time. Computer-readable media may include, for example, without limitation, storage media such as a direct access storage device (for example, a hard disk drive or floppy disk drive), a sequential access storage device (for example, a tape disk drive), compact disk (CD), CD read only memory (CD-ROM), digital video disc (DVD), the "CLOUD", RAM, ROM, electrically erasable programmable read-only memory (EEPROM), flash memory, biological memory, deoxyribonucleic acid (DNA) or molecular memory or any combination thereof, as well as communications media such wires, optical fibers, microwaves, radio waves, and other electromagnetic and/or optical carriers, and/or any combination of the foregoing.

FIG. 1 is a schematic diagram of an apparatus 100 for transferring material in a wellbore 130. Generally, apparatus 100 illustrates a system for transferring material into a surface-located hydrocarbon well site 112. The well site 112 is located at, about or over a hydrocarbon bearing formation 114, which is located below a ground surface 116. While well site 112 is illustrated at a ground surface 116, the present disclosure contemplates any one or more embodiments implemented at a well site at any location, including, at sea above a subsea hydrocarbon bearing formation. While one or more embodiments relate to a formation 114, a well site 112 or apparatus 100, the present disclosure contemplates use of a pumping system 142 at any other suitable location or for any other suitable purpose.

The wellbore 130 is formed through various earth strata including the formation 114. A pipe or casing 132 is insertable into the wellbore 130 and may be cemented within the wellbore 130 by cement 134. A centralizer/packer device 138 may be located in the annulus between the wellbore 130 and the casing 132 just above the formation 114, and a centralizer packer device 140 is located in the annulus between the wellbore 130 and the casing 132 just below the formation 114. A pumping system 142 according to one or more aspects of the present disclosure is located at the well site 112. The pumping system 142 is configured to transfer material or fluid including but not limited to, water, linear gel, cross-linked gel, breaker, friction reducer, surfactant, biocide, sand, proppant, diverter, any other fluid (such as a well stimulation fluid) or any combination thereof. The pumping system 142 may be controlled by a control system 144 located at the well site 112 (as illustrated). In one or more embodiments, control system 144 may be located remote from the well site 112. In one or more embodiments, control system 144 may comprise one or more information handling systems, such as the information handling system 200 described with respect to FIG. 2.

Figure 2:
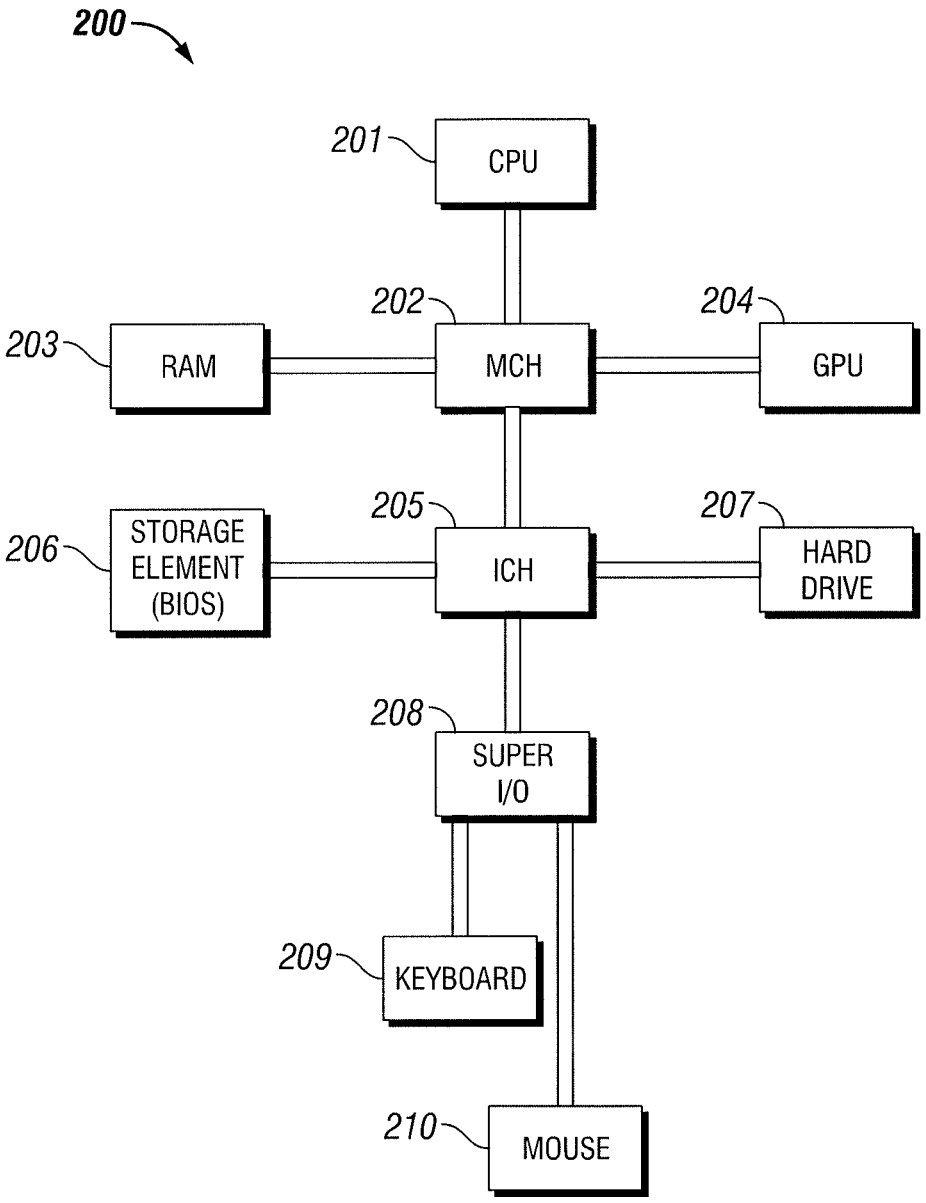
FIG. 2 is a diagram illustrating an example information handling system, according to one or more aspects of the present disclosure.

FIG. 2 is a diagram illustrating an example information handling system 200, according to aspects of the present disclosure. The control system 144 may take a form similar to the information handling system 200 or include one or more components of information handling system 200. A processor or central processing unit (CPU) 201 of the information handling system 200 is communicatively coupled to a memory controller hub or north bridge 202. The processor 201 may include, for example a microprocessor, microcontroller, digital signal processor (DSP), application specific integrated circuit (ASIC), or any other digital or analog circuitry configured to interpret and/or execute program instructions and/or process data. Processor 201 may be configured to interpret and/or execute program instructions or other data retrieved and stored in any memory such as memory 203 or hard drive 207. Program instructions or other data may constitute portions of a software or application for carrying out one or more methods described herein. Memory 203 may include read-only memory (ROM), random access memory (RAM), solid state memory, or disk-based memory. Each memory module may include any system, device or apparatus configured to retain program instructions and/or data for a period of time (e.g., computer-readable non-transitory media). For example, instructions from a software or application may be retrieved and stored in memory 203 for execution by processor 201.

Modifications, additions, or omissions may be made to FIG. 2 without departing from the scope of the present disclosure. For example, FIG. 2 shows a particular configuration of components of information handling system 200. However, any suitable configurations of components may be used. For example, components of information handling system 200 may be implemented either as physical or logical components. Furthermore, in some embodiments, functionality associated with components of information handling system 200 may be implemented in special purpose circuits or components. In other embodiments, functionality associated with components of information handling system 200 may be implemented in configurable general purpose circuit or components. For example, components of information handling system 200 may be implemented by configured computer program instructions.

Memory controller hub (MCH) 202 may include a memory controller for directing information to or from various system memory components within the information handling system 200, such as memory 203, storage element 206, and hard drive 207. The memory controller hub 202 may be coupled to memory 203 and a graphics processing unit (GPU) 204. Memory controller hub 202 may also be coupled to an I/O controller hub (ICH) or south bridge 205. I/O controller hub 205 is coupled to storage elements of the information handling system 200, including a storage element 206, which may comprise a flash ROM that includes a basic input/output system (BIOS) of the computer system. I/O controller hub 205 is also coupled to the hard drive 207 of the information handling system 200. I/O controller hub 205 may also be coupled to a Super I/O chip 208, which is itself coupled to several of the I/O ports of the computer system, including keyboard 209 and mouse 210.

In certain embodiments, the control system 144 may comprise an information handling system 200 with at least a processor and a memory device coupled to the processor that contains a set of instructions that when executed cause the processor to perform certain actions. In any embodiment, the information handling system may include a non-transitory computer readable medium that stores one or more instructions where the one or more instructions when executed cause the processor to perform certain actions. As used herein, an information handling system may include any instrumentality or aggregate of instrumentalities operable to compute, classify, process, transmit, receive, retrieve, originate, switch, store, display, manifest, detect, record, reproduce, handle, or utilize any form of information, intelligence, or data for business, scientific, control, or other purposes. For example, an information handling system may be a computer terminal, a network storage device, or any other suitable device and may vary in size, shape, performance, functionality, and price. The information handling system may include random access memory (RAM), one or more processing resources such as a central processing unit (CPU) or hardware or software control logic, read only memory (ROM), and/or other types of nonvolatile memory. Additional components of the information handling system may include one or more disk drives, one or more network ports for communication with external devices as well as various input and output (I/O) devices, such as a keyboard, a mouse, and a video display. The information handling system 200 may also include one or more buses operable to transmit communications between the various hardware components. Any one or more information handling systems 200 may be utilized to complete any one or more tasks or operations. The one or more information handling systems 200 may be communicatively coupled to any one or more other information handling systems 200 via a network including, but not limited to, a local area network (LAN), wide area network (WAN), or any other type of network. In one or more embodiments, one or more information handling systems 200 may disposed or positioned remotely from the site, for example, site 100 of FIG. 1 and may be communicatively coupled to one or more components at the site 100 via one or more connections including but not limited to a satellite, a private or public network, a secured internet communications system, any other connection and any combination thereof.

Figure 3:
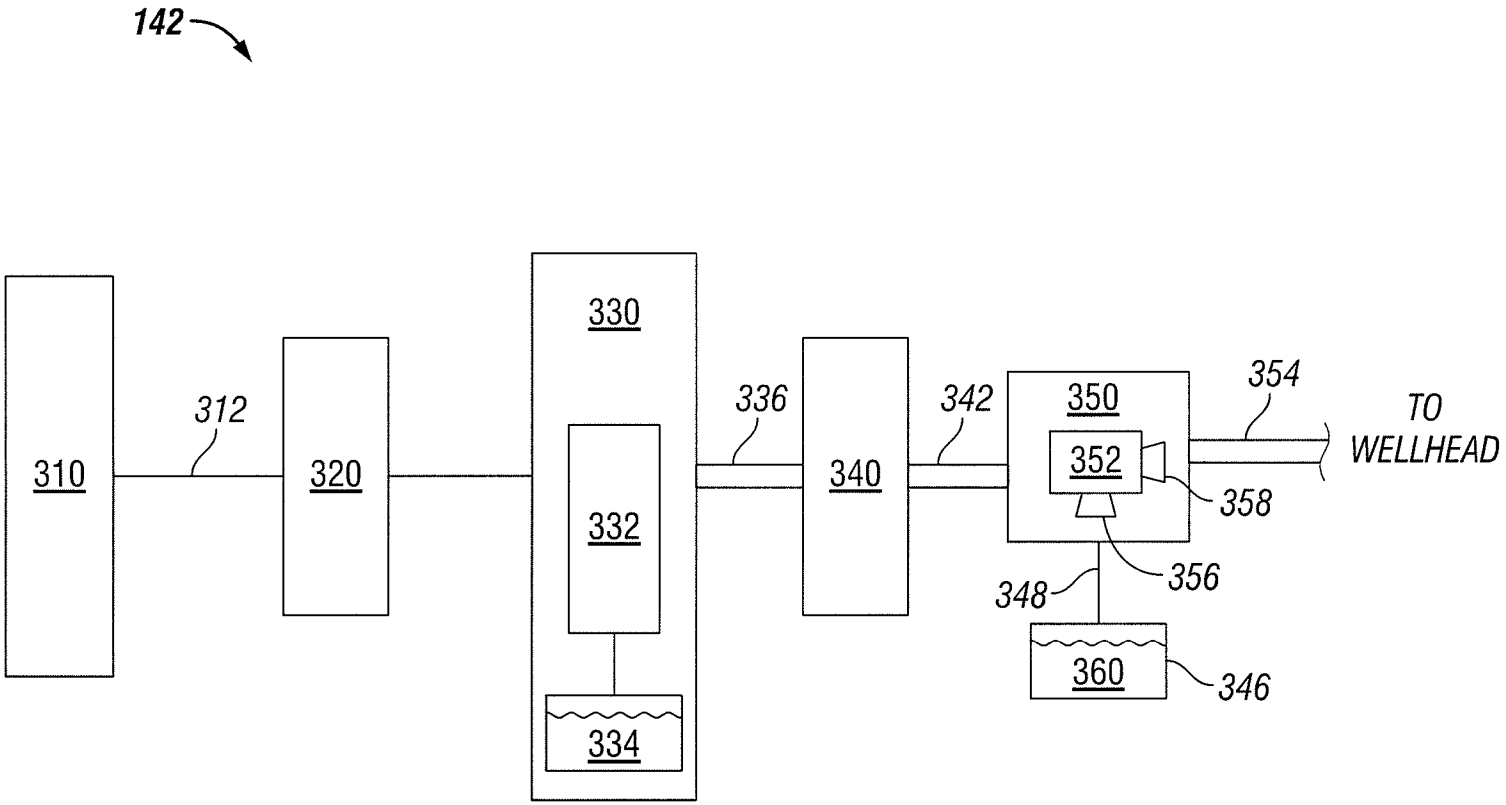
FIG. 3 is a schematic diagram of a pumping system for pumping materials downhole, according to one or more aspects of the present disclosure.

FIG. 3 is a schematic diagram of a pumping system 142 for pumping a fluid 360 downhole, for example in wellbore 130 of FIG. 1, according to aspects of the present disclosure. In one or more embodiments, a pumping system 142 comprises an engine 310, a gearbox 320, a hydraulic pumping system 330, an intensifier control system 340, and an intensifier pumping system 350. Any one or more components of the pumping system 142 may be located on the surface 116, a truck, a trailer, a barrel, a tank, a skid, a vessel, a railcar, any other vehicle, surface or any other suitable location. The engine 310 may comprise an electric, diesel, gas, wind, water or any other suitable engine, motor or turbine for providing power to one or more hydraulic pumps 332 of a hydraulic pumping system 330. For example, in one or more embodiments, engine or motor 310 may comprise one or more turbines. The type of engine 310 may depend on one or more factors including, but not limited to, any one or more of the efficiency of the engine 310, the required speed, torque level, power capacity, and pressure required by the hydraulic pumping system 330, weight, size or power density of engine 310, cost of engine 310, and fuel type.

Power from the engine 310 may be transferred to or used to drive one or more hydraulic pumps 332 of hydraulic pumping system 330 via a gearbox 320. In one or more embodiments, gearbox 320 may comprise a transmission. In one or more embodiments, a gearbox 320 may be optional. A drive shaft or drive line 312 from engine 310 may couple to gearbox 320. Gearbox 320 may couple to one or more hydraulic pumps 332 of the hydraulic pump system 330. Each gearbox 320 may couple to any one or more hydraulic pumps 332. In one or more embodiments, the gearbox 320 is not necessary and one or more engines 310 couple directly to one or more hydraulic pumps 332.

Hydraulic pumping system 330 may comprise one or more hydraulic pumps 332 for pumping hydraulic fluid 334 to one or more intensifiers 352. Hydraulic fluid 334 may include, but is not limited to, an oil, water or antifreeze. In one or more embodiments, a pumping system 142 may comprise any number or quantity and any type of hydraulic pumping systems 330. For example, in one or more embodiments, any number of hydraulic pumps 332 may pump hydraulic fluid 334 to the one or more intensifiers 352 at a specified pressure. Hydraulic pump 332 may comprise any type of hydraulic pump including, but not limited to, a variable displacement hydraulic pump (for example, axial piston pump or bent axis pump).

Any one or more of the hydraulic pumps 332 may be coupled to an intensifier control system 340 via one or more associated hydraulic fluid flow lines 336. Intensifier control system 340 may comprise or couple to an information handling system 200 for controlling the rate, volume and pressure of output of the received hydraulic fluid 334 from the fluid flow lines 336 to one or more intensifiers 352 via intensifier fluid flow lines 342. The intensifier control system 340 distributes the hydraulic fluid 334 from the one or more hydraulic pumps 332 to the one or more intensifiers 352. In one or more embodiments, the hydraulic fluid 334 may be conveyed, delivered or flowed to the one or more intensifiers 352 via intensifier fluid flow line 342 either directly or indirectly (for example, via hydraulic fluid flow line 336 to intensifier control system 340 and intensifier fluid flow line 342). Intensifier fluid flow line 342 may comprise any one or more of a valve, control line, surge tanks or any other tubing, device or mechanism that times or manages the delivery of the hydraulic fluid 334 to the one or more intensifiers 352 such that a relatively constant flow of hydraulic fluid 334 or other treatment fluid (not shown) is maintained.

The intensifier pumping system 350 comprises an intensifier 352. In one or more embodiments, the intensifier pumping system 350 comprises one or more intensifiers 352 or one or more banks of intensifiers where each bank of intensifiers comprises one or more intensifiers 352. Any one or more intensifiers 352 of a bank of intensifiers may be selected and individually controllable, for example, by the intensifier control system 340. Any one or more intensifiers 352 of a bank of intensifiers may be grouped into groups where each group is individually controllable. An intensifier control system 340, a control system 144 or any combination thereof may control or regulate the distribution or flow of hydraulic fluid 334 to an intensifier 352.

The intensifier 352 may couple to or comprise an inlet port assembly 356 and an outlet port assembly 358. Inlet port assembly 356 may couple to an inlet port flow line 348. Inlet port flow line 348 may couple to a source 346 that comprises a fluid 360. Source 346 may comprise a container, pit or any other storage unit suitable for storing or housing fluid 360. In one or more embodiments, fluid 360 to be pumped downhole is received at or drawn into an inlet port assembly 356 of intensifier 352 via inlet port flow line 348. Fluid 360 may comprise cement, slurry, water, air, linear gel, cross-linked gel, break, friction reducer surfactant, biocide, sand, proppant, diverter, any other stimulation or fracking fluid, any other material or any combination thereof. The intensifier 352 transforms the hydraulic power received via hydraulic fluid flow lines 342 to a force that pumps or flows the fluid 360 via an outlet port flow line 354 coupled to the outlet port assembly 358. The pressurized fluid 360 may be flowed or directed to a wellhead or one or more other output flow lines 354 at a specified pressure, for example, a pressure greater than that of the hydraulic fluid pressure. The one or more output flow lines 354 may comprise piping or tubing and may convey, transmit, flow or otherwise deliver the fluid 360 at a high pressure downhole, for example, via a wellhead of wellbore 130.

In one or more embodiments, the pumping system 142 is controlled via a control system 144. Control system 144 may comprise one or more information handling systems 200 or one or more methods of control system 44 may be performed manually. Control system 144 may communicatively couple directly or indirectly, via a wire or wirelessly, or by any other communication system or combination thereof to any one or more components of the pumping system 142 including, but not limited to, the engine 310, the gearbox 320, the hydraulic pump 332, the intensifier control system 340, the intensifier 352 or any combination thereof.

Figure 4:
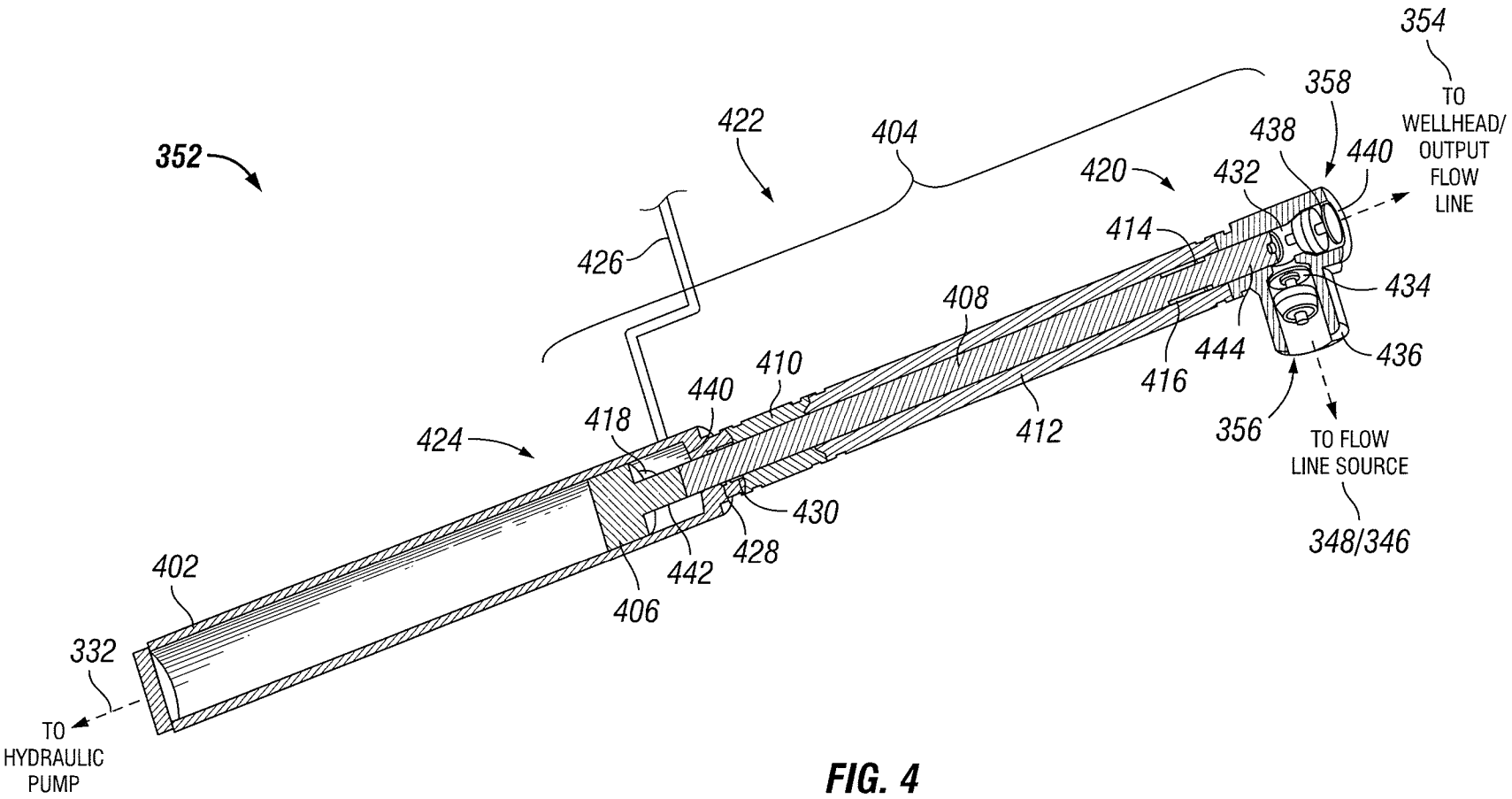
FIG. 4 is a cross-section diagram of an intensifier of a pumping system for pumping materials downhole, according to one or more aspects of the present disclosure.

FIG. 4 is a cross-sectional diagram of an intensifier 352, according to one or more aspects of the present disclosure. Conventional intensifiers utilized at a hydrocarbon exploration, recovery or production site comprise a plunger or ram which increases the overall footprint of the pumping system. The intensifier 352 of FIG. 4 reduces the overall footprint by utilizing a piston assembly 404, instead of a plunger-based intensifier, which allows for a decrease in the overall length of the intensifier 352.

The intensifier 352 comprises one or more components that are inspectable, removable, replaceable, repairable or any combination thereof. The intensifier 352 comprises a hydraulic power section 424, a piston shaft section 422 and a flow section 420. The hydraulic power section 424 comprises a hydraulic cylinder 402 and a control stop 418. In one or more embodiments, the hydraulic power section 424 comprises a coupler 430 for easy or quick connection of the hydraulic power section 424 to one or more other components or sections. A piston end 406 is disposed or positioned within the hydraulic cylinder 402 and translates within the hydraulic cylinder 402 based, at least in part on the hydraulic fluid 334 pumped from a hydraulic pump 332. Pressure in the hydraulic cylinder 402 may be based, at least in part, on the hydraulic fluid 334, the intensifier control system 340 or both.

The piston shaft section 422 couples to the hydraulic power section 424, for example, via a coupler 430. The piston shaft section 422 comprises a piston cylinder 412. In one or more embodiments, one or more spacer sections 410 are coupled to or otherwise disposed between the hydraulic power section 424 and the piston shaft section 422. For example, a spacer section 410 may couple at a first end to the coupler 430 of the hydraulic power section 424 and at a second end to the piston shaft section 422. A spacer section 410 extends the piston cylinder 412 to a length required for a specified piston assembly 404 stroke length.

The piston assembly 404 comprises a piston end 406 coupled to a piston shaft 408. Piston end 406 may comprise a piston end shaft 442 that is an elongated portion of the piston end 406. The piston shaft 408 may comprise or be coupled to a piston head 444. In one or more embodiments, the piston end 406, the piston shaft 408 and the piston head 444 couple together to form a piston assembly 404 such that any one or more of the piston end 406, piston shaft 408 and piston head 444 may be inspected, removed, replaced or repaired independent of any one or more other components of the piston assembly 404. In one or more embodiments, a plurality of the piston end 406, the piston shaft 408 and the piston head 444 are a single or composite component. The piston assembly 404 is disposed or positioned at least partially within the hydraulic cylinder 402 such that the piston shaft 408 translates in and out of the hydraulic cylinder 402 and piston cylinder 412. The piston shaft 408 may comprise a seal groove 416 disposed or positioned circumferentially about the piston shaft 408 distal from the piston end 406. One or more piston seals 414 may be disposed within, partially within or substantially within the seal groove 416 to form a seal between the piston shaft 408 and the piston cylinder 412 to prevent any leakage or debris, for example, fluid 360, from contaminating the hydraulic cylinder 402. In one or more embodiments, the one or more piston seals 414 may comprise any type of seals, one or more piston bearing bands seals, or any combination thereof. In one or more embodiments, the piston seals 414 may comprise one or more chevron seals.

A control stop 418 may be disposed on or positioned within the hydraulic cylinder 402 to control the translational movement of the piston end 406 within the hydraulic cylinder 402. The control stop 418 may comprise an opening or aperture in the hydraulic cylinder 402 such that when the piston end 406 translates over or otherwise cover or substantially cover the control stop 418, the pressure in the hydraulic cylinder 402 prevents or stops translational movement of the piston end 406 such that the piston end 406 does not contact an end wall 440 of the hydraulic cylinder 402.

One or more hydraulic cylinder seals 428 may be disposed within coupler 430 of the hydraulic power section 424 to prevent fluid 360 from being drawn into the hydraulic cylinder 402. As the fluid 360 is generally abrasive, corrosive or erosive and may cause damage to components over time, preventing or substantially minimizing the amount of such fluids 360 from contacting the hydraulic cylinder 402 extends the life of the hydraulic cylinder 402. In one or more embodiments, the one or more hydraulic cylinder seals 428 may comprise an o-ring type synthetic rubber, or, for example, a PolyPak® seal.

A service return line 426 may fluidically couple to the hydraulic cylinder 402 at any position or location after the control stop 418 and end wall 440 or coupler 430. As the piston end 406 is prevented from moving beyond the control stop 418, actuation of the service return line 426 releases pressure in the hydraulic cylinder 406 so that the piston end 406 translates towards the end wall 440 to an extended position without causing damage to the piston end 406 or the hydraulic cylinder 402. In one or more embodiments, the piston shaft section 422 is disconnected prior to translating the piston end 406 to an extended position. When the piston end 406 is in an extended position, the piston end 406 may contact or engage the end wall 440 and the piston end shaft 442 or a portion of the piston end shaft 442 may extend beyond the coupler 430. For example, a maintenance operation may be performed that requires the piston end 406 to be in an extended position. The piston end 406 may be translated towards the end wall 440 or the piston shaft section 422 by actuation of the service return line to place the piston end 406 in an extended position which exposes the piston end shaft 442 such that a maintenance operation may be performed. In one or more embodiments, piston shaft section 422 is not disconnected and the piston shaft 408 is extended when the piston end 406 is in an extended position so that one or more piston seals 414 are extended beyond the piston cylinder 412 allowing a maintenance operation on the one or more piston seals 414, the piston head 444 or both. In one or more embodiments, a maintenance operation may comprise an inspection, repair, removal, replacement, any other maintenance operation or combination thereof.

A flow section 420 is coupled to the piston shaft section 422. The flow section 420 comprises a flow cylinder 432 fluidically coupled to an outlet port assembly 358 and an inlet port assembly 356. The inlet port assembly 356 may comprise an inlet valve 434 and an inlet port 436. The inlet port 436 may couple to a flow line 348 or to a source 346 from which a fluid 360 may be drawn. The outlet port assembly 358 may comprise an outlet valve 438 and an outlet port 440. The outlet port 440 may couple to an output flow line 354 or to any other line, piping or tubing, for example, a tubing that fluidically couples the outlet port assembly 358 to a wellhead of a wellbore 130. Fluid 360 is drawn into the flow cylinder 432 and piston cylinder 412 from inlet port assembly 356 during a suction stroke of the piston assembly 404 and the fluid 360 is pressurized and flowed through the outlet port assembly 358 during a discharge stroke of the piston assembly 404. In one or more embodiments, the coupler 430, the one or more spacer sections 410 and the piston shaft section 422 have the same or substantially the same outer diameter. In one or more embodiments, this outer diameter of the coupler 430, the one or more spacer sections 410 and the piston shaft section 422 is smaller than the inner diameter of the flow cylinder 432 of the flow section 420. The coupler 430 may also comprise two or more longitudinally separate sections such that the longitudinally separated sections may be removed from the hydraulic power section 424 even with the piston shaft 408 coupled to the piston end 406.

In one or more embodiments, a plunger (not shown) may replace piston end 406.

Figure 5:
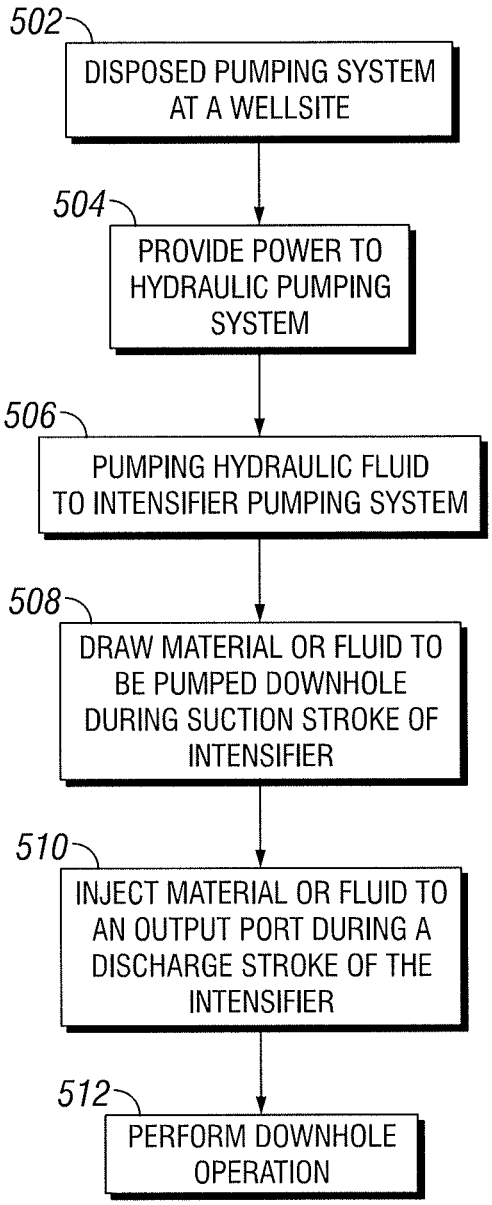
FIG. 5 is a flowchart of a method for pumping material downhole, according to one or more aspects of the present disclosure.

FIG. 5 illustrates a flowchart for pumping a material or fluid downhole, according to one or more aspects of the present disclosure. At step 502, a pumping system 142 is disposed or positioned at a wellsite 112 as discussed above with respect to FIG. 1. The pumping system may comprise any one or more systems, components or other equipment discussed above with respect to FIGS. 1, 2, 3 and 4.

At step 504, power is provided to a hydraulic pumping system 330 via an engine 310 as illustrated in FIG. 3. At step 506, a hydraulic pump 332 of hydraulic pumping system pumps a hydraulic fluid 334 at a specified or predetermined pressure to an intensifier pumping system 350. In one or more embodiments, an intensifier control system 340 may control the rate or discharge of hydraulic fluid 334 to one or more intensifiers 352 of intensifier pumping system 350 and may independently control or activate the one or more intensifiers 352.

At step 508, fluid 360 to be pumped downhole is drawn into the intensifier 352 during a suction stroke of the intensifier 352. For example, fluid 360 may be drawn in an inlet port assembly 356 and into the piston shaft 408 as the piston end 406 translates during a suction stroke of the intensifier 352 causing the piston shaft 408 to translate at least partially into the hydraulic power cylinder 402. At step 510, during a discharge stroke, the fluid 360 is flowed at a specified or predetermined pressure to outlet port assembly 358. The fluid 360 pressurized by the intensifier 352 is flowed to a wellbore 130, for example, via one or more output flow lines 354. In one or more embodiments, the fluid 360 is pressurized, based, at least in part, on the hydraulic fluid 334 pumped from hydraulic pump 332, the stroke length of the piston assembly 404 of the intensifier 352, outlet valve 438, outlet port assembly 358, to one or more flow lines 354.

At step 512, a downhole operation is performed. For example, the fluid 360 pressurized by the intensifier 352 may be flowed via one or more output flow lines 354 to a wellbore 130. In one or more embodiments, the downhole operation comprises a stimulation operation.

Figure 6:
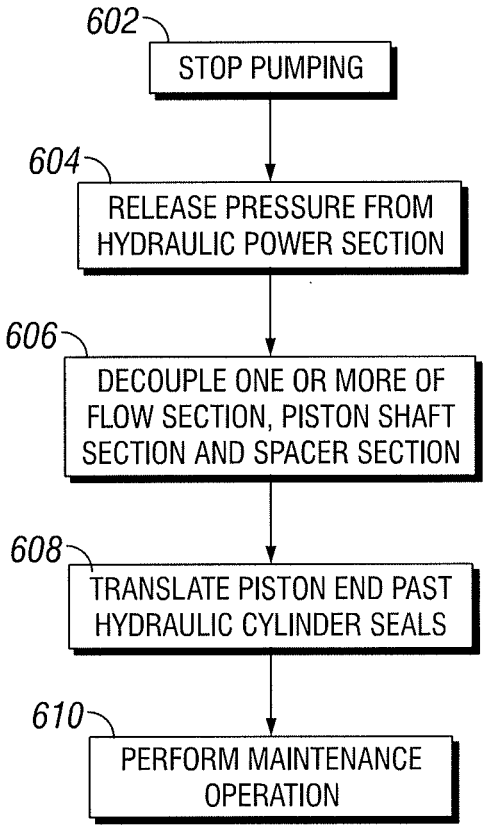
FIG. 6 is a flowchart of a method of a maintenance operation for a pumping system, according to one or more aspects of the present disclosure.

FIG. 6 illustrates a method for performing a maintenance operation for a pumping system 142 as discussed above with respect to FIGS. 1-4, according to one or more aspects of the present disclosure. At step 602, pumping of a hydraulic pump 332 and intensifier 352 is stopped, pause or otherwise discontinued. At step 604, a service return line 426 is actuated to release pressure in the hydraulic cylinder 402 of the intensifier 352. Releasing the pressure allows translational movement of the piston end 406 such that at least a portion of the piston end 406, for example, a portion of piston end shaft 442, may be exposed or extendable past or beyond coupler 430 and seals 428.

At step 606, one or more components of the intensifier 352 are decoupled or otherwise disconnected from each other. For example, any one or more of the flow section 420, the piston shaft section 422, any one or more spacer sections 410 and hydraulic power section 424 may be disconnected from any one or more other sections. At step 608, the piston end 406 is allowed to translate towards end wall 440 such that at least a portion of the piston end 406, for example, at least a portion of the piston end shaft 442, is exposed or extended beyond the coupler 430, the seal 428 or any combination thereof. Translating the piston end 406 in this way exposes the piston shaft 408 such that the piston shaft 408 may be inspected, repaired or replaced.

At step 610, a maintenance operation may be performed on any one or more components of the intensifier 352. A maintenance operation may comprise any one or more of inspection, removal, repair or replacement of one or more components of the intensifier including, but not limited to, one or more hydraulic cylinder seals 428, piston shaft 408, piston cylinder 412, spacer section 410, one or more piston seals 414, inlet valve 434, outlet valve 438, flow section 420, hydraulic power section 424 or any combination thereof.

In one or more embodiments, a pumping system for pumping a fluid downhole comprises an engine, a hydraulic pump coupled to the engine, wherein the engine drives the hydraulic pump, an intensifier coupled to the hydraulic pump, wherein the intensifier comprises a hydraulic power section coupled to the hydraulic pump, a piston shaft section coupled to the hydraulic power section and a flow section coupled to the piston shaft section, wherein a piston assembly translates between the hydraulic power section and the piston shaft section, a fluid, wherein the intensifier pressurizes the fluid to be pumped downhole. In one or more embodiments, the intensifier further comprises a spacer section disposed between the piston shaft section and the hydraulic power section. In one or more embodiments, e piston assembly comprises a piston end coupled to a piston shaft. In one or more embodiments, the hydraulic power section comprises a hydraulic cylinder, and wherein the piston end is disposed within the hydraulic cylinder. In one or more embodiments, the hydraulic power section comprises one or more hydraulic seals, wherein the piston shaft translates between the one or more hydraulic seals, and wherein the one or more hydraulic seals seal the hydraulic cylinder from the fluid. In one or more embodiments, the pumping system further comprises a service return line fluidically coupled to the hydraulic cylinder, wherein the service return line actuates to relieve pressure in the hydraulic cylinder to allow the piston end to translate past the one or more hydraulic seals to an extended position. In one or more embodiments, the piston shaft is removable from the piston end when the piston end is translated to the extended position. In one or more embodiments, the piston shaft comprises a groove disposed circumferentially about the piston shaft, and wherein one or more piston seals are disposed within the groove.

In one or more embodiments, a method for performing a downhole operation comprises pumping a hydraulic fluid from a pump to an intensifier at a first pressure, wherein the intensifier comprises a hydraulic power section, a piston shaft section and a flow section, translating a piston assembly of the intensifier within a piston cylinder of the piston shaft section and a hydraulic cylinder of the hydraulic power section based, at least in part, on the hydraulic fluid, drawing a fluid through an inlet port assembly of the flow section into a piston cylinder of the piston shaft section during a suction stroke of the piston assembly, and flowing the fluid at a second pressure through the outlet port assembly of the flow section during a discharge stroke of the piston assembly, wherein the second pressure is greater than the first pressure of the hydraulic fluid. In one or more embodiments, the method further comprises preventing the fluid from flowing into the hydraulic cylinder based, at least in part, on one or more hydraulic cylinder seals disposed about a coupler of the hydraulic cylinder. In one or more embodiments, the method further comprises performing a stimulation operation based, at least in part, on the pressurized fluid. In one or more embodiments, the method further comprises stopping pumping of the hydraulic fluid, performing a stimulation operation based, at least in part, on the pressurized fluid, releasing pressure from the hydraulic cylinder and translating a piston end of a piston assembly to an extended position. In one or more embodiments, the method further comprises disconnecting a flow section from a piston shaft section of the intensifier, wherein the piston shaft section is coupled to the hydraulic power section and disconnecting a piston shaft of the piston assembly from the piston end. In one or more embodiments, the method for pumping further comprises disconnecting a flow section from a piston shaft section of the intensifier, wherein the piston shaft section is coupled to the hydraulic power section and replacing one or more piston seals disposed within a groove of the piston shaft.

In one or more embodiments, an intensifier pumping system comprises a hydraulic power section coupled to a hydraulic pump at a first end, wherein the hydraulic power section receives a hydraulic fluid from the hydraulic pump at a first pressure, a piston shaft section coupled to the hydraulic power section and a flow section coupled to the piston shaft section, wherein a piston assembly translates between the hydraulic power section the piston shaft section to pressurize a fluid for pumping downhole at a pressure greater than the first pressure. In one or more embodiments, the system further comprises a spacer section disposed between the piston shaft section and the hydraulic power section. In one or more embodiments, the piston assembly comprises a piston end coupled to a piston shaft. In one or more embodiments, the hydraulic power section comprises a hydraulic cylinder, and wherein the piston end is disposed within the hydraulic cylinder. In one or more embodiments, the hydraulic power section comprises a cylinder, and wherein the piston end is disposed within the hydraulic cylinder. In one or more embodiments, the system further comprises a service return line fluidically coupled to the hydraulic cylinder, wherein the service return line actuates to relieve pressure in the hydraulic cylinder to allow the piston end to translate past the one or more hydraulic seals to an extended position.

The foregoing description of certain aspects, including illustrated aspects, has been presented only for the purpose of illustration and description and is not intended to be exhaustive or to limit the disclosure to the precise forms disclosed. Numerous modifications, adaptations, and uses thereof will be apparent to those skilled in the art without departing from the scope of the disclosure.

What is claimed is:

1. A method for performing a downhole operation, comprising: pumping a hydraulic fluid from a hydraulic pump to an intensifier at a first pressure, wherein the intensifier comprises a hydraulic power section, a piston shaft section and a flow section; translating a piston assembly of the intensifier within both a piston cylinder of the piston shaft section and a hydraulic cylinder of the hydraulic power section based, at least in part, on the hydraulic fluid; drawing a treatment fluid through an inlet port assembly of the flow section into the piston cylinder of the piston shaft section during a suction stroke of the piston assembly; flowing the treatment fluid at a second pressure through an outlet port assembly of the flow section during a discharge stroke of the piston assembly, wherein the second pressure is greater than the first pressure of the hydraulic fluid; stopping pumping of the hydraulic fluid; after stopping pumping, releasing pressure from the hydraulic cylinder via a service return line fluidically coupled to the hydraulic cylinder of the hydraulic power section of the intensifier, wherein the intensifier is coupled to the hydraulic pump; and translating a piston end of the piston assembly, which is disposed in the hydraulic cylinder, to an extended position wherein a piston end shaft of the piston end extends beyond an end wall of the hydraulic cylinder.

2. The method of claim 1, further comprising: preventing the treatment fluid from flowing into the hydraulic cylinder based, at least in part, on one or more hydraulic cylinder seals disposed about a coupler of the hydraulic cylinder.

3. The method of claim 1, further comprising performing a stimulation operation based, at least in part, on the pressurized treatment fluid.

4. The method of claim 1, further comprising:

performing maintenance on one or more of the piston end shaft and a piston shaft of the piston assembly.

5. The method of claim 4, further comprising:

disconnecting the flow section from the piston shaft section of the intensifier, wherein the piston shaft section is coupled to the hydraulic power section; and disconnecting the piston shaft of the piston assembly from the piston end.

6. The method of claim 4, further comprising:

disconnecting the flow section from the piston shaft section of the intensifier, wherein the piston shaft section is coupled to the hydraulic power section; and replacing one or more piston seals disposed within a groove of the piston shaft of the piston assembly.

7. The method of claim 1, wherein stopping pumping further comprises stopping flow of treatment fluid through the outlet port assembly.

8. The method of claim 1, wherein the piston assembly further comprises a piston shaft, wherein the piston end shaft is an elongated portion of the piston end extending towards the piston shaft section, and wherein the piston shaft is removably coupled to the piston end shaft.

9. The method of claim 8, further comprising disconnecting the piston shaft from the piston end shaft.

10. The method of claim 9, wherein disconnecting the piston shaft occurs after stopping pumping.

11. The method of claim 9, wherein disconnecting the piston shaft from the piston end shaft occurs after translating the piston end to the extended position.

12. The method of claim 8, further comprising disconnecting the flow section from the piston shaft section.

13. The method of claim 12, further comprising performing maintenance on one or more of the piston end shaft and the piston shaft.

14. The method of claim 8, further comprising disconnecting the flow section from the piston shaft section, and replacing one or more piston seals disposed within one or more grooves of the piston shaft.

15. The method of claim 1, wherein translating the piston end to the extended position further comprises extending at least a portion of the piston end shaft past one or more hydraulic seals configured between the hydraulic power section and the piston shaft section.

16. The method of claim 1, further comprising preventing the piston end from contacting the end wall while flowing treatment fluid through the outlet port assembly using a control stop.

17. The method of claim 16, wherein releasing pressure comprises releasing pressure via the service return line between the control stop and the end wall.

18. The method of claim 17, wherein the control stop is disposed on or positioned within the hydraulic cylinder and configured to prevent translation of the piston end to contact the end wall while flowing treatment fluid through the outlet port assembly.

19. The method of claim 1, further comprising coupling a spacer between the hydraulic power section and the piston shaft section.

20. The method of claim 19, further comprising selecting a length of the spacer based on a stroke length for the piston assembly.

* * * * *